US005759664A

United States Patent [19]

Chisnell et al.

[11] Patent Number: 5,759,664

[45] Date of Patent: Jun. 2, 1998

[54] COMPOSITE SKI

[75] Inventors: William R. Chisnell, Waterford; David P. Goode, Bloomfield Hills, both of Mich.

[73] Assignee: Goode Ski Technologies, Waterford, Mich.

[21] Appl. No.: 608,890

[22] Filed: Feb. 29, 1996

[51] Int. Cl.[6] ..... A63C 5/00

[52] U.S. Cl. ..... 428/109; 428/105; 428/107; 428/112; 428/113; 428/114; 428/192; 280/610

[58] Field of Search ..... 428/105, 107, 428/109, 112, 113, 114, 192; 280/610

[56] References Cited

U.S. PATENT DOCUMENTS

| | | | |
|---|---|---|---|
| 3,704,023 | 11/1972 | Downs | 280/11.13 |
| 3,879,245 | 4/1975 | Fetherston et al. | 156/245 |
| 3,897,074 | 7/1975 | Tiitola | 280/11.13 |
| 3,902,732 | 9/1975 | Fosha, Jr. et al. | 280/11.13 |
| 3,918,731 | 11/1975 | Legrand | 280/11.13 |
| 3,933,362 | 1/1976 | Sakuma et al. | 280/11.13 |
| 3,949,988 | 4/1976 | Stauter | 273/73 |
| 3,967,992 | 7/1976 | McCaskey, Jr. et al. | 156/85 |
| 4,035,000 | 7/1977 | Lacroix | 280/610 |
| 4,065,150 | 12/1977 | Van Auken | 280/610 |
| 4,068,861 | 1/1978 | Zemke | 280/610 |
| 4,071,264 | 1/1978 | Legrand et al. | 280/610 |
| 4,077,652 | 3/1978 | McCaskey, Jr. et al. | 280/610 |
| 4,118,051 | 10/1978 | Shima | 280/610 |
| 4,146,251 | 3/1979 | Tanahashi | 280/610 |
| 4,175,767 | 11/1979 | Scheruebl | 280/610 |
| 4,180,275 | 12/1979 | Montoya | 280/11.37 E |
| 4,209,867 | 7/1980 | Abrams, III | 9/310 |
| 4,272,578 | 6/1981 | Schegerin | 428/113 |
| 4,293,142 | 10/1981 | Davignon | 420/610 |
| 4,412,687 | 11/1983 | Andre | 280/610 |
| 4,416,929 | 11/1983 | Krueger | 428/102 |
| 4,518,453 | 5/1985 | Kirsler et al. | 156/307.5 |
| 4,530,871 | 7/1985 | You | 428/111 |
| 4,595,215 | 6/1986 | Tiitola | 280/604 |
| 4,634,140 | 1/1987 | Strol | 280/610 |
| 4,667,977 | 5/1987 | Lacroix | 280/602 |
| 4,679,813 | 7/1987 | Girard | 280/602 |
| 4,679,814 | 7/1987 | Meatto et al. | 280/610 |
| 4,705,815 | 11/1987 | Longeray et al. | 521/160 |
| 4,725,070 | 2/1988 | Maruyama | 280/610 |
| 4,902,548 | 2/1990 | Cholat-Serpound | 428/102 |
| 5,141,243 | 8/1992 | Meatto | 280/602 |
| 5,160,158 | 11/1992 | Scherübl | 280/610 |
| 5,171,509 | 12/1992 | LeMasson et al. | 280/610 |
| 5,183,618 | 2/1993 | Pascal et al. | 264/257 |
| 5,217,243 | 6/1993 | Recher et al. | 280/610 |
| 5,238,260 | 8/1993 | Scherü | 280/610 |

FOREIGN PATENT DOCUMENTS

| | | |
|---|---|---|
| 0081834 | 12/1982 | European Pat. Off. . |
| 01160582 | 6/1989 | Japan . |
| 05293840A | 11/1993 | Japan . |

*Primary Examiner*—Kathleen Choi
*Attorney, Agent, or Firm*—Young & Basile, P.C.

[57] ABSTRACT

An improved composite ski structure comprising a core with a successful layering of at least two alternately diagonally offset composite layers, covered by two outer longitudinal layers. Both the top and bottom surfaces of the core are layered in this fashion, and the composite layers are preferably applied as a multi-layered outer laminate wrapped fully around the core. In a preferred form, a multi-functional epoxy is applied to bond the inner surface of the composite laminate to the core. In a further form of the invention at least the tip, and preferably also the tail of the core are formed from composite inserts, and at least the tip section of the outer laminate is cut in a herringbone pattern to be wrapped around a curved/angled tip without stress cracking. The invention also comprises a method for making a ski structure as described.

9 Claims, 3 Drawing Sheets

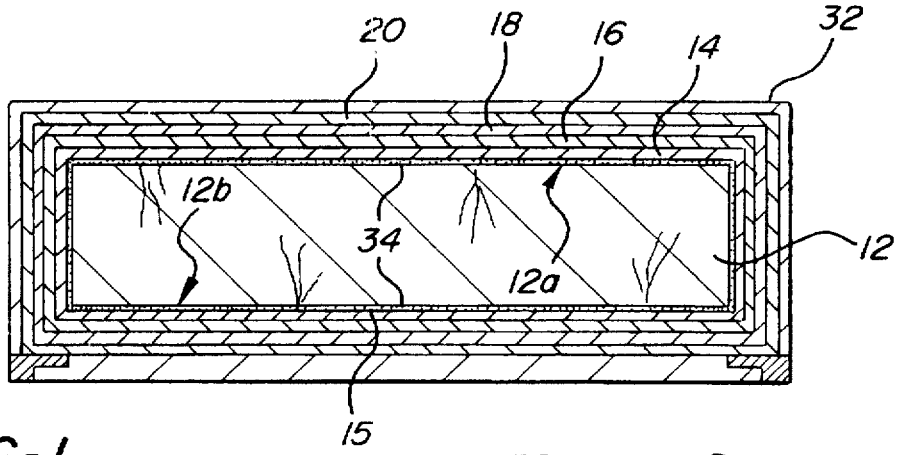
FIG-1
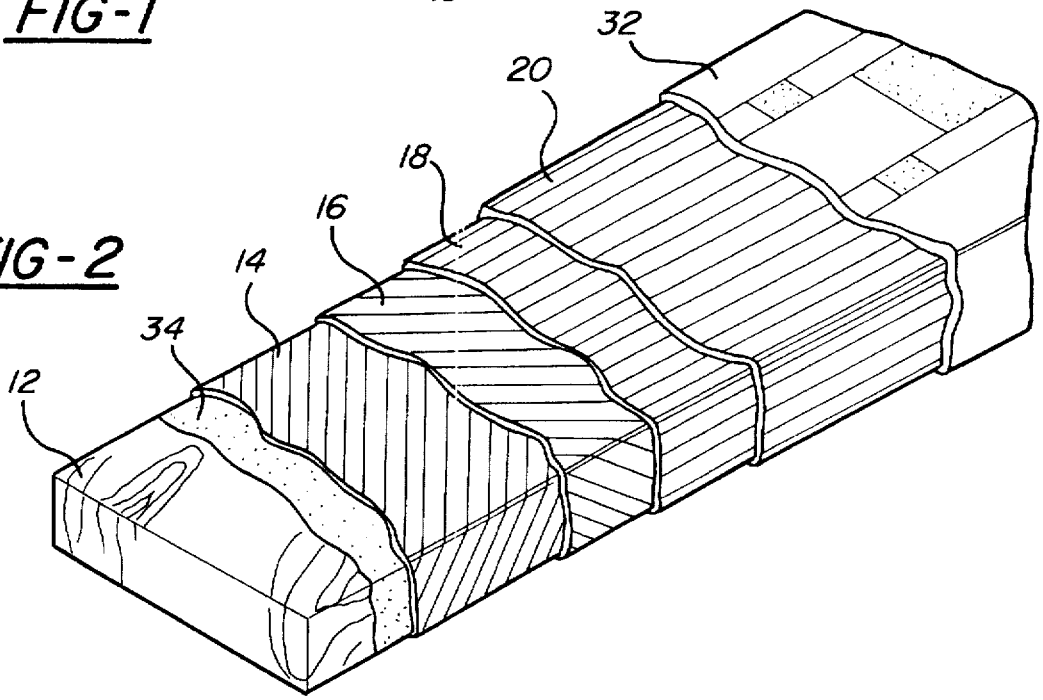
FIG-2
FIG-3
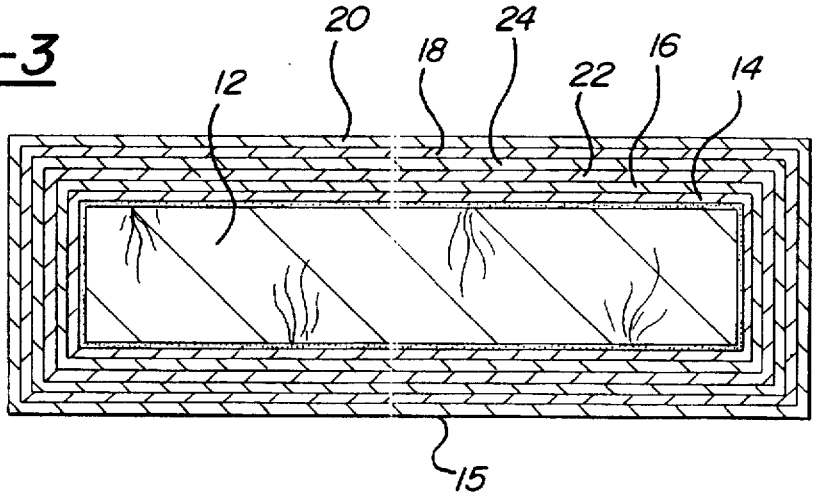

COMPOSITE SKI

FIELD OF THE INVENTION

The present invention is related to skis, and more particularly to skis made with fiber/resin composites.

BACKGROUND OF THE INVENTION

Skis have traditionally been made from combinations of wood or foam cores with plastic, metal or fiberglass laminated over the cores. The many different combinations of these materials have typically had the goal of producing a ski with good flex, torsional rigidity, high strength and light weight.

With the commercial availability of resin-impregnated carbon fiber materials, attempts have been made to achieve the desired characteristics using high strength, low weight carbon fiber composites. One such attempt is U.S. Pat. No. 3,902,732 to Fosha, Jr. et. al, disclosing a ski having a core made from honeycomb, wood or foamed plastic, with reinforcing layers of resin-impregnated graphite fibers on the top and bottom of the core. A layer of longitudinally extending graphite fibers is placed above the core and a second longitudinal layer of fibers is placed immediately below the core, while two 90° opposed layers of fibers at 45° from the longitudinal are placed on top of the longitudinal layers. The core and the graphite reinforcing layers are encased in high density polyethylene slabs, commercially known as "P-tex®". This structure forms the basic ski; additional layers of longitudinal or 45° fibers can be layered above and below the core to extend in stepwise varying lengths to achieve desired flexural and torsional strengths and flexibility patterns.

Other patents which teach the layering of fiber reinforced resin sheets over or around a core material include Japanese patent application No. JP05293840A published Nov. 9, 1993, in which "pre-preg" carbon fiber tape is wound at an angle of +45°, and then −450°, to the longitudinal direction of the core material; U.S. Pat. No. 3,879,245 to Fetherston et al, disclosing a method of molding a composite ski body in which layers of structurally reinforced resins are either wrapped around the core or placed on the top and bottom of the core; U.S. Pat. No. 5,183,618 to Pascal et al; and U.S. Pat. No. 4,634,140 to Stroi.

SUMMARY OF THE INVENTION

The present invention is a composite ski construction which has been found to produce a flex/torsion ratio and light weight unmatched by any prior art construction. The resulting ski has a flex/torsion ratio significantly better (lower) than available skis, and a weight as low as one-half that of other skis.

In general the novel composite ski comprises a core, preferably but not necessarily of wood or wood laminations, with evenly balanced top and bottom layers or wrappings of composite fiber/resin sheets, for example pre-preg carbon fiber. In its basic form, the top and bottom surfaces of the core are each successively layered with: a diagonally offset fiber layer, an oppositely offset diagonal fiber layer, and two outer layers of longitudinal fibers. In a preferred form the diagonally offset inner layers are offset ±45° from the longitudinal axis of the ski.

In a further embodiment of the invention, the ±45° layers above and below the core are doubled, such that four such layers are located on each of the upper and lower surfaces of the core, sandwiched between the core and the above-mentioned double longitudinal layers.

In yet a further form of the invention, the tip and tail of the ski are formed from solid carbon fiber inserts. The wood core is replaced with inserts made from multiple layers of alternating ±90° carbon fiber sheets, for example twelve such layers. The carbon fiber tip and tail sections which replace the wood core are still wrapped within the basic +45/−45/longitudinal/longitudinal layers surrounding the wood core along the majority of the ski's length. In yet a further embodiment, the core's junction with the carbon fiber tip is cut in a triangular shape, and the carbon fiber outer layers are folded over in a "herringbone" pattern to eliminate stress cracks.

A further feature of the invention is an epoxy coating applied to the core between the core and the first of the carbon fiber layers. This application of epoxy seals the core, prevents absorption of the carbon fiber epoxy (which would leave dry fibers), and further helps the laminated top and bottom carbon fiber layers float longitudinally and torsionally relative to the core.

The resulting ski is longitudinally "soft" or flexible, but torsionally stiff, and is about one-half the weight of traditional skis. These and other advantages of the invention will become apparent upon further reading of the specification.

BRIEF DESCRIPTION OF THE DRAWINGS

FIG. 1 is a transverse sectional view of a ski according to the present invention showing the laminated composite layers wrapped around the core;

FIG. 2 is a multi-section perspective view of the ski of FIG. 1;

FIG. 3 is a transverse section view of an alternate embodiment of the inventive ski construction, showing additional laminated composite layers added to the structure of FIG. 1;

DETAIL DESCRIPTION OF THE DRAWINGS

Figure 4:
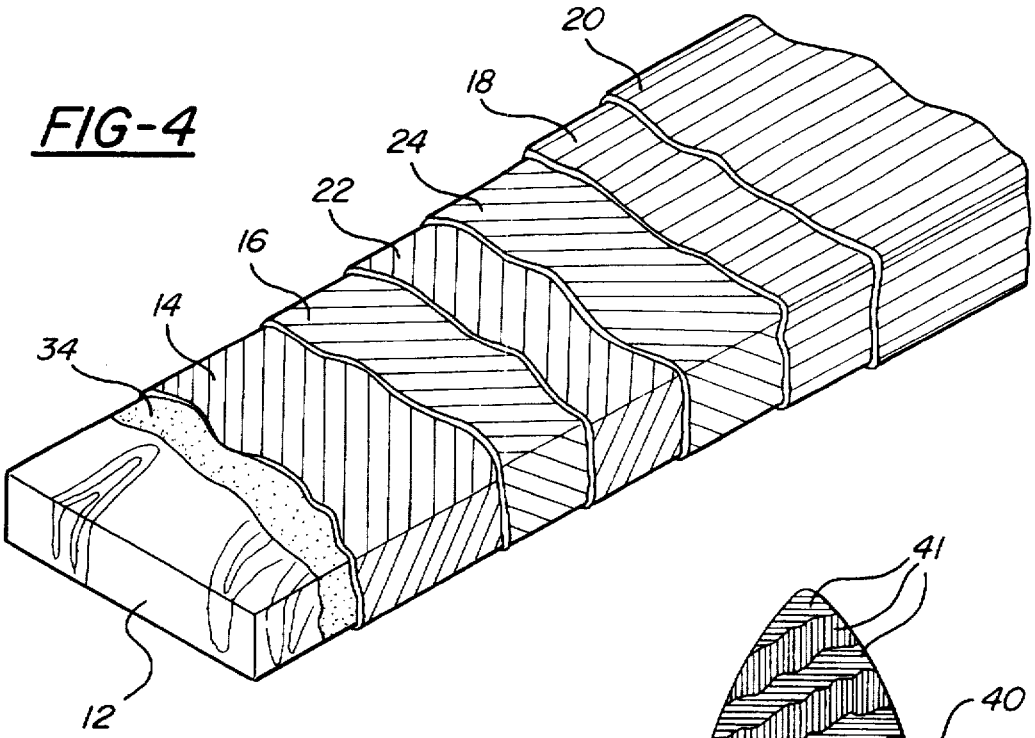
FIG. 4 is a multi-section perspective view of the ski of FIG. 3.

Referring to FIG. 1, a first ski construction according to the present invention is shown in transverse section comprising a wood core 12 wrapped by layers of pre-preg carbon fiber unidirectional tape. Core 12 is surrounded by an evenly balanced, symmetrical set of carbon fiber layers above and below the core. From the top surface 12*a* of core 12 the carbon fiber sheets are successively layered as follows: +45° layer 14, −45° layer 16, longitudinal layer 18, longitudinal layer 20. In the wraparound construction of FIG. 1, the bottom and side layers are identical: +45° diagonally offset layer 14, −45° diagonally offset layer 16, longitudinal layer 18, longitudinal layer 20.

It should be understood that while the illustrative preferred embodiment uses a ±45° diagonal offset, some variation in the degree of diagonal offset may be possible.

A bonded edge base 30 of known type, for example the commercially available "P-tex", is secured to bottom layer 20 in known manner, in the illustrated embodiment by epoxy. Additionally, the upper surface of the ski may be defined by a graphics layer 32 which is heat sealed onto the underlying carbon fiber layer 20 when the ski is heated and pressurized in a curing mold. In a preferred form, the graphics layer comprises a perforated acrylic with graphics silkscreened on the lower side, for example Korad®, a commercially available material.

In the illustrated embodiment the 45° layer immediately adjacent the core is not directly attached to the core, but rather to a layer of epoxy 34 which is applied directly to the core to seal it and prevent absorption of the resin in the carbon fiber sheets, which would leave dry fibers susceptible to breakage. In preferred embodiment, the epoxy is of as type known a) "multifunctional", for example EPON 829 available from Shell Oil Co., which remains flexible or stretchable when cured to allow the laminated top and bottom carbon fiber layers to float longitudinally and torsionally relative to the core.

In the illustrated embodiment the carbon fiber layers are commercially available sheets of carbon fiber pre-impregnated with thermoset epoxy, with the carbon fiber density being approximately 150 grams per square meter. Such pre-preg sheets of carbon fiber are available, for example, from Brite Technologies and comprise approximately 40% resin to fiber ratio with a tensile strength of approximately 300,000 psi and a flexural modulus of approximately $25\times10^6$.

In the illustrated embodiment, the core is a vertically laminated alternating fir core of a type generally known in the art, although it is possible to use other core materials such as foamed plastics or different types of wood as known to those skilled in the art.

As shown in the illustrated embodiment, the carbon fiber layers are preferably wrapped around the core such that they are continuous around both sides of the core and terminate in a centered seam 15 on the bottom surface of the ski (covered by the P-tex base layer). It may be possible, however, to layer the fiber sheets on the top and bottom surfaces of the core without completely wrapping the core, although this is a more expensive and time-consuming procedure.

The resulting ski is soft longitudinally and stiff torsionally, whereas a traditional ski is stiff longitudinally and soft torsionally. The resulting ski is also approximately one-half the weight of a traditional ski.

Referring now to FIGS. 3 and 4, an alternate embodiment of the invention is illustrated in cross-section. In this embodiment, two additional ±45° layers 22, 24 have been added above and below the core, contiguous with the original 45° layers. This further increases the torsional rigidity of the ski, which is desired by some skiers in performance-oriented skiing activities such as racing.

Figure 5:
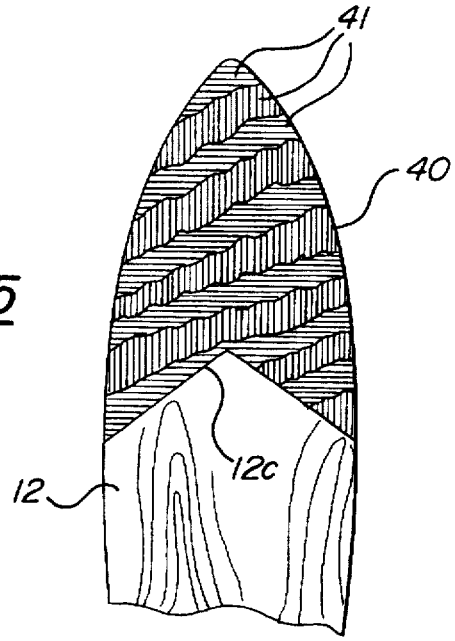
FIG. 5 is a plan view of a ski utilizing the structure of FIG. 1, in which the core is replaced with a "solid" fiber/resin tip and tail comprising multiple laminated composite layers.

Referring now to FIG. 5, in a preferred embodiment the multi-layered ski of the present invention, whether that of FIG. 1 or FIG. 3, is provided with tip and tail sections 40, 42 comprised of "solid" carbon fiber layers, instead of a continuation of the wood core 12. In the illustrated embodiment the tip and tail comprise twelve alternating layers 41 of plus or minus 90° carbon fiber pre-preg sheets sandwiched between the ±45° layers and the longitudinal layers surrounding the core 12. As shown in FIG. 5, core 12 adjacent tip 40 is formed in an arrowhead style. It has been found that epoxy from the multi-layered carbon fiber tip 40 flows into and mates with the wooden core upon heating and curing.

The wraparound outer laminate layers 14, 16, 18, 20 are cut and folded over as shown at 40*a* in herringbone fashion to eliminate stress cracks at the curved/angled junction of the solid tip portion 40 and core tip 12*c*, and along with the herringbone junction between the two results in a strong, flexible, nearly unbreakable tip.

Figure 6:
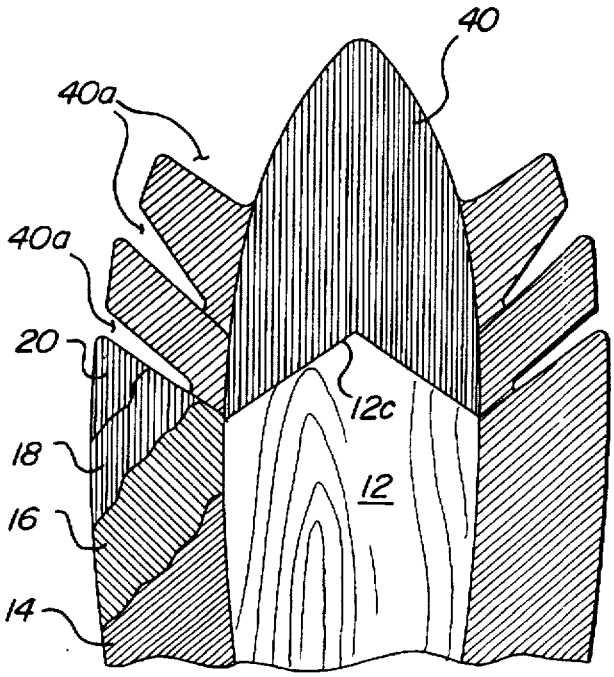
FIG. 6 is a plan view of the tip of FIG. 5, illustrating a structure and method for wrapping the tip without stress cracks in the outer laminate layers.
Figure 7:
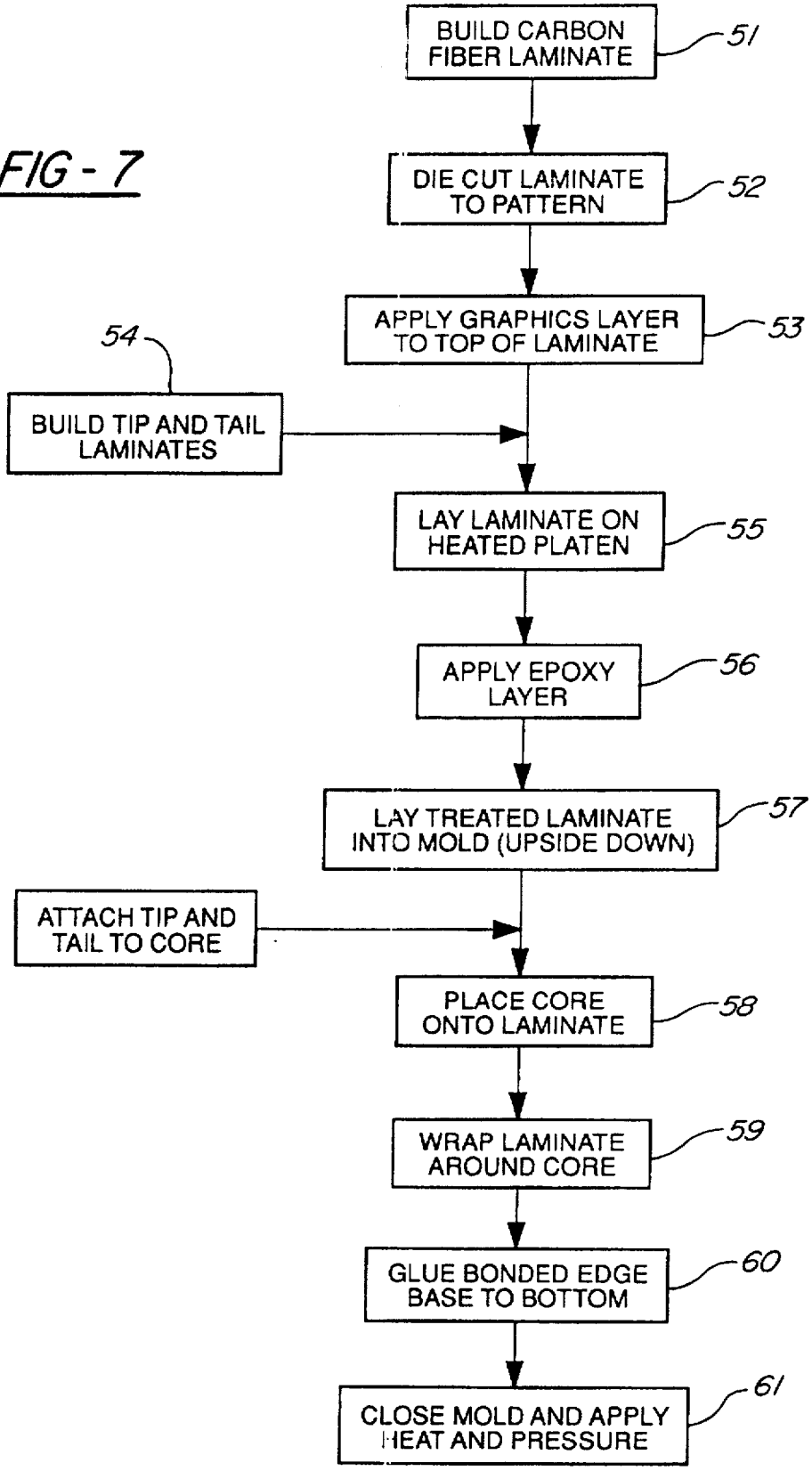
FIG. 7 illustrates the method for making a ski according to the present invention in schematic flowchart form.

Referring now to FIG. 7, the method for forming a ski as described above is illustrated in schematic flowchart form. At step 51, the wrap-around laminate of 45° and longitudinal carbon fiber pre-preg sheet layers 14, 16, 18, 20 are built up. In step 52, the built up outer laminate 30 is die cut to the shape of the mold pattern so that it will wrap precisely around the core 12 of the ski. The herringbone tip wrap design illustrated in FIG. 6 is formed in the multi-layer laminate at this step.

Optionally, at step 53 perforated graphics layer 32 can be aligned with and heat sealed onto the laminate substrate so that the ski will have a decorated upper surface when it comes out of the mold. Such graphics are generally known to those skilled in the art.

In step 54, the tip and tail sections 40 and 42 are attached with suitable epoxy to the "bottom" side of the laminate which is to be epoxied to the core. In step 55, the assembled laminate with tip and tail sections attached is laid on a heated platen (approximately 115° F.), and the epoxy layer is added at step 56 to the laminate surfaces which will be wrapped around in contact with the core.

In step 57 the assembled laminate is laid into the ski mold (upside down), and in step 58 the core is placed into the mold in position on the laminate. In step 59, the laminate is folded over and around the core to create a centered seam running the length of the lower surface of the core.

In step 60, a bonded-edge base of known type is epoxied to the bottom carbon fiber layer over the centered seam 15.

Finally, in step 61, a top punch is lowered into the mold to apply heat and pressure (approximately 100 to 150 psi at 250° F. for one hour) to cure all of the layers of the ski and create a finished product. The foregoing illustrative embodiment is of a preferred structure and method, and is not intended to be limiting beyond the scope of the appended claims. For example, while the foregoing illustrated embodiment is described in connection with making a snow ski, it is also possible to apply the same structure and method to making a snowboard or water ski; only the relative core thickness and contour would be changed for a snowboard or water ski embodiment.

Accordingly, we claim:

1. A composite ski construction, comprising:

A core; and successive layers of fiber reinforced resin composite material from top and bottom surfaces of the core, layered from the core outward with at least first and second alternating diagonally offset layers successively adjacent the core, the first and second diagonally offset layers comprising layers of unidirectional fibers offset diagonally relative to a longitudinal axis of the ski, the first layer being diagonally offset in a first direction, and the second layer being diagonally offset in a second opposed direction, and two longitudinal layers on top of the diagonally offset layers wherein a layer of epoxy is applied between the core and the first diagonally offset layer.

2. The ski construction of claim 1, further including two additional alternating diagonally offset layers between the core and the longitudinal layers.

3. The ski construction of claim 1, wherein the ski has a tip comprising a solid composite insert.

4. The ski construction of claim 3, wherein the diagonally offset layers and the longitudinal layers together form an outer laminate which is wrapped around the core and at least a portion of the composite tip section.

5. The ski construction of claim 4, wherein the outer laminate comprises a herringbore pattern of angled portions adjacent the tip of the ski, the angled portions being wrapped around the tip section at an angle which reduces stress cracks.

6. The ski construction of claim 1, wherein the first and second diagonally offset layers are offset 45° from the longitudinal axis of the ski.

7. The ski construction as defined in claim 1, wherein the ski construction comprises a water ski.

8. The ski construction as defined in claim 1, wherein the ski construction comprises a snowboard.

9. The ski construction as defined in claim 1, wherein the ski construction comprises a snow ski.

* * * * *

UNITED STATES PATENT AND TRADEMARK OFFICE

CERTIFICATE OF CORRECTION

PATENT NO. : 5,759,664

DATED : 6-2-98

INVENTOR(S) : Chisnell et al.

It is certified that error appears in the above-identified patent and that said Letters Patent is hereby corrected as shown below:

Column 2, line 3, delete "The" and insert --At the tip and tail, the--;

Column 2, line 27, after "ski" insert --construction--;

Column 2, line 30, after "ski" insert --construction--;

Column 2, line 35, after "ski" insert --construction--;

Column 4, line 47, delete "from" and insert --on--;

Column 4, line 55, after "and" insert --with--

Signed and Sealed this

Twentieth Day of July, 1999

*Attest:*

*Attesting Officer*

Q. TODD DICKINSON

*Acting Commissioner of Patents and Trademarks*